United States Patent [19]

Crawford

[11] Patent Number: 4,666,148

[45] Date of Patent: May 19, 1987

[54] FACIAL MUSCLES EXERCISE MASK

[76] Inventor: Johnathan G. Crawford, 14101 Calle Vista Dr., Riverside, Calif. 92508

[21] Appl. No.: 830,630

[22] Filed: Feb. 18, 1986

[51] Int. Cl.[4] ..... A63B 23/00

[52] U.S. Cl. ..... 272/95; 272/130; 272/DIG. 5

[58] Field of Search ..... 272/95, 68, 130, 99; 128/24 R, 24.1, 380, 24.2, 64; 2/413, 424, 425, 9

[56] References Cited

U.S. PATENT DOCUMENTS

| | | | |
|---|---|---|---|
| 1,096,761 | 5/1914 | Scheer | 2/424 |
| 2,507,858 | 5/1950 | Kegel | 272/93 X |
| 2,676,587 | 4/1954 | Corcoran | 128/64 |
| 3,606,890 | 9/1971 | Gilbert | 128/380 |
| 4,068,323 | 1/1978 | Gwon | 2/425 |
| 4,189,141 | 2/1980 | Rooney | 272/95 |
| 4,574,787 | 3/1986 | Jacobs | 128/24.2 |

*Primary Examiner*—Richard J. Apley
*Assistant Examiner*—James Prizant

[57] ABSTRACT

A facial exercise mask includes an externally convex mask body made of strong, lightweight plastic or acrylic. A central face portion has holes for eyes, nose, and mouth of the wearer. An inflatable lining for the inner surface of the mask at brow, temple, cheek, chin, and central portions, and having corresponding holes for the eyes, nose, and mouth is provided. Air is pumped between the lining and the inner surface of the mask body to inflate the lining which provides the resistive force for the facial muscles to work against. The entire mask may be held in place by two sets of adjustable head strap assemblies or by a single broad adjustable head strap assembly.

1 Claim, 3 Drawing Figures

FACIAL MUSCLES EXERCISE MASK

FIELD OF INVENTION

This invention concerns a facial muscles resistance exercise mask and more specifically concerns a facial muscles resistance exercise mask for use in conjunction with appropriate exercises to improve the tonicity of the facial muscles.

DISCUSSION OF PRIOR ART

It has been established for many years that the facial muscles like those of the rest of the human body, can improve in tonicity by exercises practiced over a long period of time and on a consistent basis. The present invention is intended to significantly reduce the time required to comfortably and effectively achieve good facial muscle tonicity when used in a systematic way with appropriate exercises. Quicker and better results are achieved in a shorter time by the controllable resistive force of the mask which increases the effectiveness of the exercises. Heretofore, only one prior invention was found which involved a facial exercise mask which used weights placed into pockets that are sewn in the material that makes up the body of the mask. A disadvantage of that invention is that it cannot work effectively and comfortably at the same time. The force of gravity will naturally pull the weights downward away from the muscles they were intended to provide resistance for, since the material of the mask is "elastic two-way stretch cloth". Therefore, to realize even a limited amount of effectiveness, the wearer would necessarily have to strap the mask on very tightly which would then smash the weights uncomfortably against the wearer's facial tissues and bones. Another disadvantage is the weight of the mask when the weights are placed in their pockets. As the wearer's facial muscles develope and becomes stronger, heavier weights will be required to increase the effectiveness of the exercises. This would further increase the weight of the mask. Still another disadvantage of that invention is the potential for causing bruises to the wearer's facial tissues with the weights smashed against them for effectiveness. Even soft paddings would not solve this potential problem. The present invention however is constructed in a manner to comfortably and effectively improve facial exercises when worn during performance of the exercises. The present invention provides a light-weight mask body constructed of strong durable, rigid plastic or acrylic including an inflatable mask lining made from soft nonporous plastic or vinyl. With the exception of the eyes, nose and mouth, the mask and lining cover the entire face from the top of the forehead to below the chin, the sides of the face from just forward of the temples including the sides of the forehead and the upper and lower jaws. The mask body is held in place during use by adjustable head and chin strap or by a single adjustable wide headband. The lining is attached to the concave or inner portion of the mask body in such a manner as to allow air to be pumped in between the inner surface of the mask body and the surface of the lining facing the mask body. An air pump is permanently attached to the outer portion of the mask body, and is used for inflating the mask lining which can be pumped up to a desired pressure thereby improving the effectiveness of facial exercises when the mask is used during the performance of the exercises. Also on the outer surface of the mask body, are an air pressure gauge with which to measure the air pressure within the mask, plug/pressure-relief valve for deflating the mask and prevent the buildup of excessive pressure, and a Timing/Calorie-Estimating Device for timing the duration of the exercises and calculating the approximate numbers of calories spent during the exercise session.

OBJECTS

It is therefore a principal object of the present invention to provide a facial mask covering the entire face, brow and chin, made of durable lightweight, rigid plastic or acrylic forming the mask body with a inflatable lining made of strong flexable plastic or vinyl for comfortably improving the effectiveness of facial muscle exercises.

Another object of the present invention is to provide a mask as described fitted with strap means for holding the mask in place while in use.

Another object of the present invention is to provide a mask as described with an inflatable lining made of a material that can easily be cleaned after each use with soap, water and a soft cloth.

Another object of the present invention is to provide a mask as described with the safety feature of a pressure-relief valve to prevent excessive air pressure buildup.

Another object of the present invention is to provide a mask as described with an air pressure gauge to aid in selecting desired air pressure.

A further object of the present invention is to provide a mask as described with a device capable of timing and alerting the user at the end of the selected time, and also calculating the approximate number of calories spent during the exercises.

These and other objects and many of the attendant advantages of this invention will be readily appreciated as the same becomes better understood by reference to the following detailed description when considered in connection with the accompanying drawings in which:

DRAWINGS

DESCRIPTION

Figure 1:
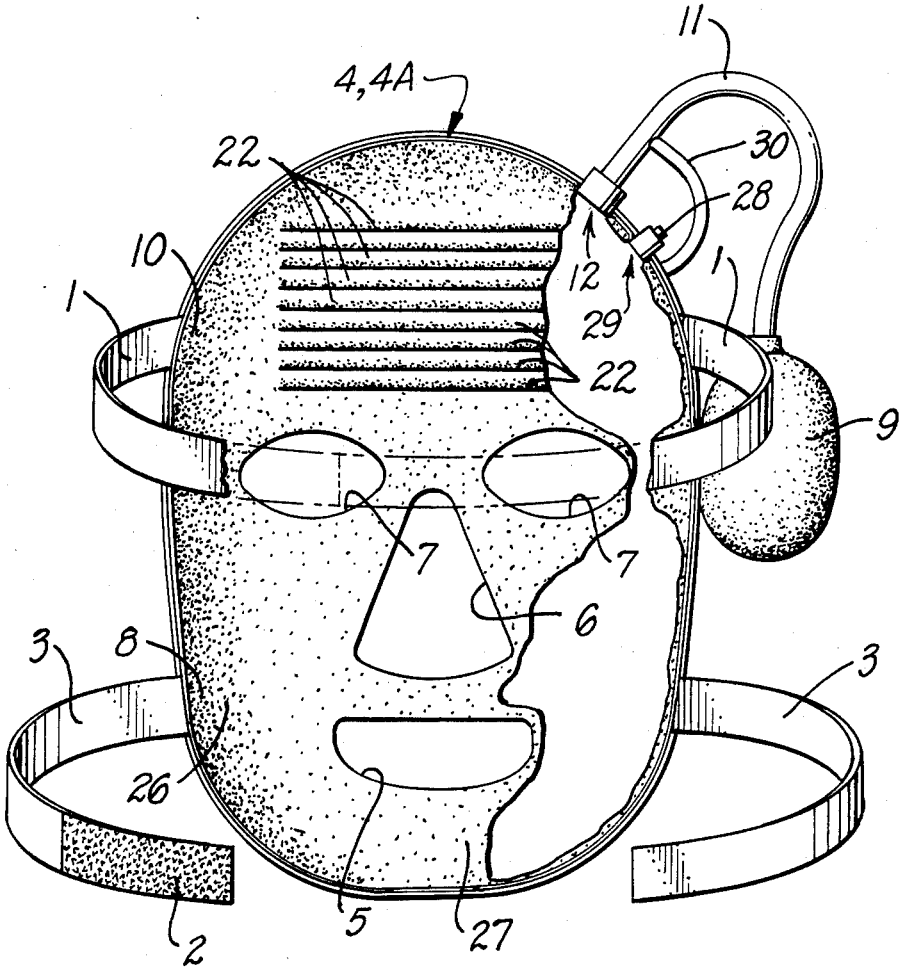
FIG. 1 is a rear view of a facial exercise mask embodying the present invention showing portions of the concave surface of the mask body and the lining with cut-away sections.
Figure 2:
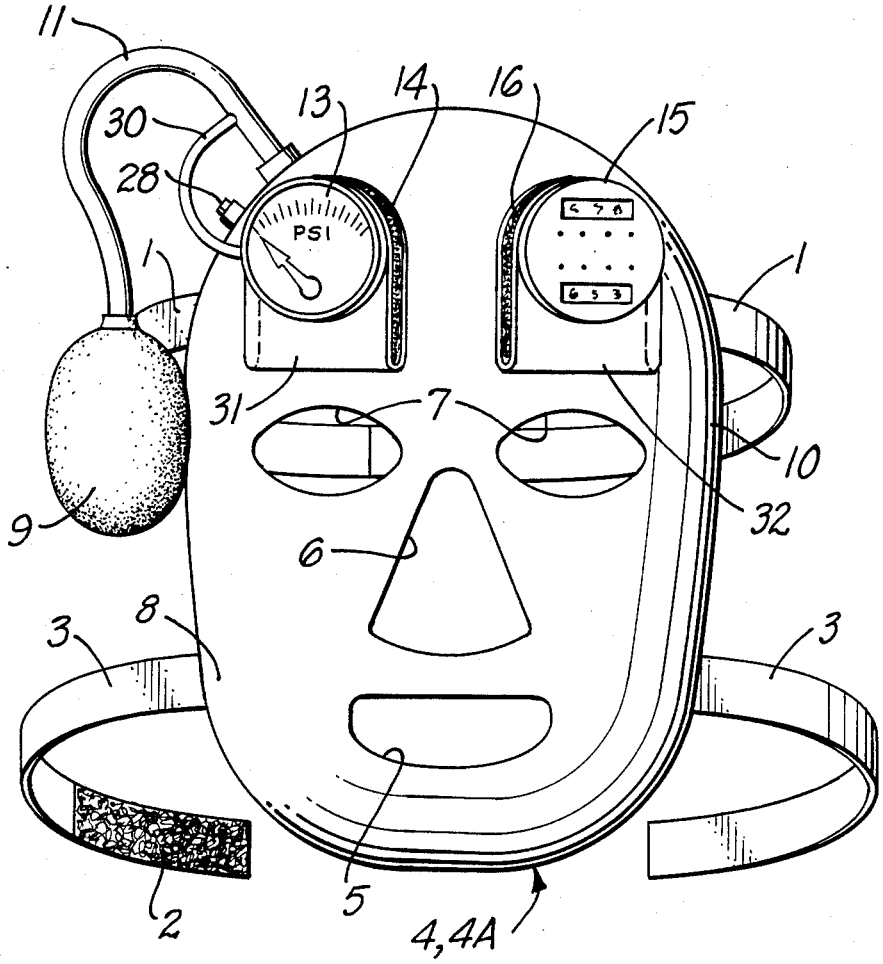
FIG. 2 is a front view of a facial exercise mask embodying the present invention.
Figure 3:
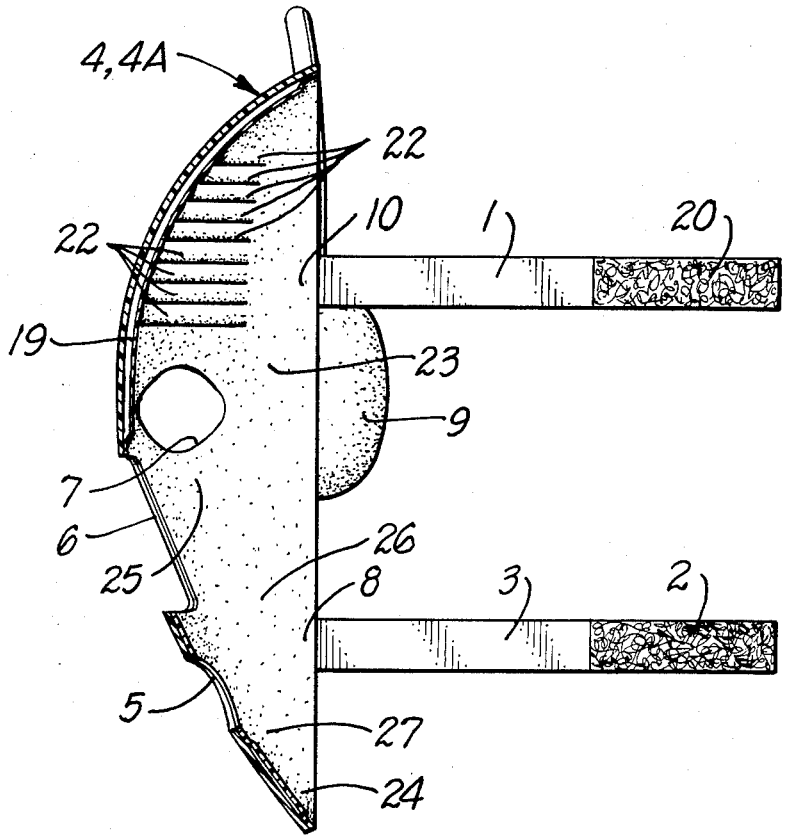
FIG. 3 is a cross-sectional side view showing the attachment of the inflatable lining to the mask body.

Referring now to the drawings wherein like reference characters designate like or corresponding parts throughout, there is illustrated in FIGS. 1–3, a facial mask generally designated as reference numeral 4, having an inflatable lining 19 which when inflated conforms to the shape of the face of the person using it for facial exercise purposes. The mask body 4A is constructed of hard, strong, lightweight plastic or acrylic, and is sufficiently large (there will be several sizes available) to fit over the face of the wearer. The lining 19 when inflated, will fit smugly against and conform to the shape of the wearer's brow at an upper portion 22, to the temples at an upper side portion 23, to the face at a central portion 25, to the cheeks at each of the lower side portions 26, to the front of the chin below the mouth 27, and to the bottom of the chain 24 toward the throat. In the central portion are formed two holes 7 which will surround the wearer's eyes, a lower hole 6 through which the wearer's nose will protude, and a lowermost hole 5 which will surround the wearer's mouth. The inflatable lining 19 is attached to the inner portion of the mask body 4A in in such a way that while the mask 4 is in use, the lining 19 will not block the holes 5, 6, and 7, but rather will also act as a cushion along the rims. The lining 19 is made from a soft nonporous material able to withstand up to at least 20 psi of air pressure, and is attached to the inner(concave) portion of the mask body 4A so that when inflated, the air is trapped between the surface of the lining 19 facing the inner surface of the mask body 4A and the inner surface of the mask body 4A covered by the lining 19. The brow portion 22 of the lining 19 has horizontal grooves to correspond with the furrows of the wearer's raised brows, thereby aiding in the effective exercise of the muscles in that portion of the wearer's face.

A tube 11 through which air from a pump 9 passes to inflate the lining 19, enters from the outer upper top portion 12 of the mask body 4A and extends through just to the inner surface of the mask body 4A. In close proximity to where the tube enters the mask body 4A, is a second opening 29 that also extends to the inner surface of the mask body 4A for the purposes of deflating the mask lining 19 by pulling the pressure relief-valve/-plug 28 and preventing the buildup of air pressure beyond a predetermined level. The pump 9 that is attached to the air tube 11, when not in use, is stowed by velcro attachment to the outer side surface of the mask 4 as shown in FIGS. 1 and 2.

A psi meter generally designated at reference numeral 13 includes a small tube 30 that connects it to the air tube 11. The psi meter 13 is attached to the outer front of the mask 4 above one of the eye-holes 7 via a small strap 31 that has half of itself attached to the mask 4 with the meter 13 on the second half of the strap 31 and folded upward with the second half against the first half which is permanently attached to the outer mask 4, and the second half attaches to the first half with velcro 14 as shown in FIG. 2. This arrangement of the psi meter 13 allows the wearer to read it while wearing the mask 4.

Adjacent to said psi meter 13 is a Timing/Calorie-Estimating Device generally designated as reference numeral 15 which is located above the second eye-hole 7 and is attached to the outer front of the mask 4 via a small strap 32 that that has half of itself attached to the mask 4, with the meter 15 on the second half of the strap 32. The strap 32 is folded upward with the second half against the first half that is permanently attached to the outer mask 4, and the second half attaches to the first half with velcro 16 as shown in FIG. 2. This arrangement allows the wearer to read the Timing/Calorie-Estimating Device 15 while wearing the mask 4. The Timing/Calorie-Estimating Device 15 can be used for timing the duration of each exercise period, beeping an alarm at the end of the selected time, and estimating the approximate number of calories spent based on the duration of the exercise and the air pressure selected. The Timing/Calorie-Estimating Device 15 is a tiny computer-like device with manufacturer stored information.

An upper head strap assembly generally designated as reference numeral 1 and a lower head strap assembly generally designated as reference numeral 3, are provided to hold the mask 4 smugly in place on the head of the wearer during the exercise sessions. The two halves of the upper strap 1 are attached to the outer mask body 4A, one at each temple 10. The two halves of the lower strap 3 are attached to the outer mask body 4A at the lower jaw 8. Each half of the upper strap assembly 1 secured to the other half during exercise sessions with velcro 20. The velcro 20 on the two halves of the upper strap 1 covers a sufficient portion of the strap halves to facilitate adjustment for different size heads. Each half of the lower strap assembly 3 is secured to the other half during exercise sessions with velcro 2. The velcro 2 on the two halves of the lower strap assembly covers sufficient portions to facilitate adjustments for different size heads. Another possibility which could be adopted for securing the mask 4 to the wearer's head during exercise sessions, is one single very broad strap assembly with two halves that are secured to each other during exercise sessions with velcro.

While in use, the mask 4 will be mounted on the wearer's face by means of either separate straps 1 and 3 or by a single broad strap, then the inner lining 19 will be inflated to the desired pressure.

OPERATION

To use the mask for exercising the facial muscles, the wearer may choose to select the duration of the exercise and pressure to be used and enter them into the Timing-/Calorie-Estimating Device, before or after donning the mask. The same is also true with regard to the inflation of the lining. When the lining is inflated, it will conform to the contours of the wearer's face. It is best to secure the mask to the face using the upper and lower strap assemblies, then use the hand-pump to inflate the lining. The desired air pressure can be read on the psi meter and the hand-pump secured to the side of the mask. The wearer can then perform facial exercises using the inflated lining as the resistive force to work against. The horizontal grooves in the lining will fit into the similar grooves formed in the wearer's forehead when the brows are raised. This will aid in the effectiveness of the exercising of the muscles involved. The Timing/Calorie-Estimating Device is simply a watch shaped device with displays on its face for elapse time, number of estimated calories spent, and numbered buttons for entering information; internally a pre-programmed computer chip which is the brain of the device, and a beeper/alarm for alerting the wearer of the end of the selected time. The wearer enters the psi information and starts the timing. The programed chip will display the changing estimated number of calories spent as the time passes, using the time from the clock-portion of the Timing/Calorie-Estimating Device and the program and formulas in its memory. At any point that the exercises can be terminated and the user will have a display of the estimated number of calories spent to that point. As the muscle tonicity and strength improves, the air pressure can be increased for continued improvement. Additionally, the mask and lining will exert a massaging effect which will increase blood circulation and improve oxygen supply to the areas involved.

The following are several exercises which may be performed while wearing the mask.

1. Brow Muscle—The eyebrows are raised vertically upward as far and as hard as possible to contract this muscle. Then the eyebrows are lowered to relax this muscle.

2. Eyebrow Muscles—The eyebrows are contracted horizontally towards the nose as far and as hard as possible. Then the eyebrows are moved apart towards the respective sides of the head as far as possible. Then the muscles are relaxed moving the eyebrows back to their normal position.

3. Eye Muscles—The eyelids are closed as hard as possible and then relaxed.

4. Nose Muscles—Contract these muscles by wrinkling the nose and curling the upper lip upward. Then relax these muscles.

5. Lip and Mouth Muscles—Contract these muscles by puckering the lips then twisting the lips up, down, to the sides, and pulling them inward and pushing outward. Also clench the teeth and smile tensely.

The above mentioned are but a few of the many types of exercises that may be performed with the present invention, and are listed only as examples. Many other exercises can be employed.

When the mask is used consistently in a planned program of exercises, the several aformentioned objects and advantages are most effectively realized. While the above description contains many specificities, these should not be construed as limitations on the scope of the present invention, but rather as an exemplification of one preferred embodiment thereof. Many other variations are possible, for example:

1. Using a similar mask body but somewhat thicker, groups of tiny air or hydraulic cylinders are attached to the inner surface of the mask body via tiny steel or plastic balls half embedded into the surface, the other half supporting the bases of the cylinders thereby allowing each cylinder to rotate freely in several directions. Additionally, attached to the pistons at the other end of the cylinders is a plastic plate (curved to conform to the curviture of the portion of the face it is to cover), one for each group of cylinders. Like in the preferred embodiment, cylinder pressure (resistance) could be selected, time and estimated number of calories calculated, and the mask secured to the wearer in the same manner.

2. The previous example could be modified slightly by using tiny springs instead of the cylinders, all else remaining the same. p 3. A mask body with a lining similar to that of the preferred embodiment, but with a lining having small individual pockets with interconnections. Air would be used to pressurize a liquid in the lining, or, only hydraulic pressure could be employed to pressurize the lining. Instead of a hand-pump, a hydraulic reservoir and a small pressurization pump on the outer surface of the mask could be used if hydraulic pressure is employed.

What is claimed is:

1. A method for effectively exercising facial muscles comprising the steps of:

a. using a facial exercise mask comprising a rigid, strong, lightweight, externally convex mask body shaped to fit a wearer's face, said body having an upper brow portion, a lower chain portion below the mouth and under the chin toward the throat, upper side temple portions, lower side cheek portions, and a central portion being formed with a pair of eyeholes, a lower nosehole, and a lowermost mouth-hole; an inflatable nonporus lining attached to the inner concave portion of said body with said lining having corresponding eye, nose, and mouth holes; on outer portion of said body, a hand-pump, a psi meter, a Timing/Calorie-Estimating Device, a pressure-relief-valve/plug, and attachment means for securing said mask to wearer's face;

b. securing said mask to wearer's face;

c. inflating said lining to desired pressure with said hand-pump and said psi meter;

d. selecting duration time on Timing/Calorie-Estimating Device;

e. selectively exercising groups of facial muscles against said inflated lining's pressure thereby requiring greater muscular effort than exercising without said lining and said mask.

* * * * *